United States Patent [19]

Paglia

[11] 3,934,516

[45] Jan. 27, 1976

[54] BATCHING AND DISPERSING ASSEMBLY FOR A CONVEYOR SYSTEM

[75] Inventor: Marius F. Paglia, Calabasas Park, Calif.

[73] Assignee: Paglia Automated Conveyor Engineering, Inc., North Hollywood, Calif.

[22] Filed: July 24, 1974

[21] Appl. No.: 491,213

[52] U.S. Cl. ..... 104/172 S; 104/251; 104/253

[51] Int. Cl.[2] ..... B65G 17/42

[58] Field of Search ..... 104/162, 172 R, 172 S, 104/249–253, 256

[56] References Cited

UNITED STATES PATENTS

| | | | |
|---|---|---|---|
| 2,812,724 | 11/1957 | King | 104/172 S |
| 3,088,419 | 5/1963 | Bishop | 104/172 S |
| 3,696,756 | 10/1972 | Elmore et al. | 104/251 |
| 3,793,965 | 2/1974 | Winters | 104/172 S |
| 3,818,840 | 6/1974 | Dehne | 104/172 S |

*Primary Examiner*—Evon C. Blunk
*Assistant Examiner*—Andres Kashnikow

[57] ABSTRACT

A device for use in a conventional conveyor system which enables trolleys to be batched, accumulated and individually dispatched into the conveyor system is disclosed. The invention comprises a batching portion and dispersing assembly. Flexible exciter dogs are used to drive the trolleys through the batching portion and dispersing assembly, and are capable of bending and thereby sliding over the top of the trolleys as they accumulate. A system of solenoid switches and mechanical stops permit accumulation and individual dispatching by the dispersing assembly of trolleys as desired, such as at inclines, declines, distribution points and dispatching points.

13 Claims, 15 Drawing Figures

BATCHING AND DISPERSING ASSEMBLY FOR A CONVEYOR SYSTEM

BACKGROUND OF THE INVENTION.

1. Field of the Invention

The present invention relates to improvements in a conveyor system which utilizes trolleys to transport hanging merchandise, such as garments, said improvements relating to automatic batching, accumulating and individually dispersing features.

2. Prior Art

Conveyor systems employing an upper driving track and a lower riding track are well known in the art for use in transporting hanging goods, such as garments, in retail, manufacture and storage warehouse facilities. The conveyor systems are designed for moving large quantities of merchandise from one point in a storage warehouse to other points within that warehouse for various purposes. For example, after a new shipment of goods is received at the warehouse, they may be immediately placed on the conveyor system and dispatched to a storage location. Later, those goods may be placed back onto the conveyor system and transported to dispatch points for checking, marking, packaging or for other purposes. In most prior art devices, the individual trolleys are automatically dispatched throughout the entire conveyor system. In these prior art systems the trolleys are driven along the lower track by a unique pair of drive capturing dogs which trap the end of the trolley therebetween and drive it throughout the system. The drive capturing dogs are normally spaced apart, in a longitudinal direction by a distance of approximately 10 feet. This spacing enables the individual trolleys to be: dispatched at various points, placed onto the system, and transported up or down inclines.

One problem encountered in prior art conveyor systems is that it is not possible to introduce a large group of trolleys into the conveyor system at one time, but instead the trolleys must be handled individually into the system. Thus, if a train of trolleys is ready to be placed on the system for distribution to various points, an operator is required to individually place each trolley on the system whenever a free pair of drive capturing dogs is available. These systems are very inefficient because of the large areas of unused space in the conveyor and because of the inability to batch handle large groups of trolleys. If more than one trolley is placed onto the system without individually being captured by a unique pair of dogs, the trolleys will bind and knock each other from the track whenever an incline, decline or accumulation point is reached. Thus, it becomes imperative that an operator individually place trolleys onto the system.

Some prior art systems employ automatic feed-in devices. These devices enable a number of trolleys to be placed on a separate line which is declined so as to provide an accumulation of trolleys to the automatic feeder. The feeder places trolleys onto the system one at a time as the drive capturing dogs become available. However the problems in this system are; that separate trolley lines are required for the automatic feeder system; the device is very expensive; and the basic conveyor system is still inefficient in its space utilization.

The present invention solves these problems and provides a device which allows, batch feeding onto the conveyor system from any point along the conveyor, provides for train-like end to end transportation of the trolleys in the conveyor system, permits stopped accumulation of the trolleys within the conveyor system and allows for individual dispatching of the trolleys from the system at distribution points.

SUMMARY OF THE INVENTION.

The present invention provides a batching portion and dispersing assembly for use in a conventional conveyor system, comprising; an upper track containing a driving chain with drive capturing dogs, and a lower trolley carrying track. The batching portion comprises upper and lower tracks spaced apart such that the drive capturing dogs pass over the trolleys and do not force them along the track. Flexible exciter dogs are coupled to the driving chain for pushing trolleys along the track and through the batching portion and the dispersing assembly. The dispersing assembly provides for accumulating a train of trolleys from the batching portion and for individually dispatching the trolleys so as to be captured and carried by the spaced apart rigid drive capturing dogs. The dispersing assembly comprises a system of stops and solenoid switches. A stop accumulates the trolleys and is activated by the solenoid switches so as to release one trolley at a time into the conveyor system at each appropriate time.

An object of the invention is to provide a batching and dispersing system which is capable of being incorporated in a functional conveyor system at a low cost.

Another object of the invention is to provide a batching system for a functional conveyor system which enables maximum space usage and minimizes manual loading and the time to load.

Still another object of the invention is to provide a dispersing assembly which can accumulate trolleys arriving in a batch form and in turn individually dispatch these trolleys through the remainder of the conveyor system.

DETAILED DESCRIPTION OF THE PREFERRED EMBODIMENT

The present invention is for use in combination with a conventional conveyor system, well known in the art, which is comprised of an upper track containing a driving chain and a lower supporting track for carrying trolleys. Such trolleys are often used for carrying hanging goods such as garments or boxed and or flatfold goods on shelf carriers and thus the preferred embodiment will be described with respect to such systems. Such conveyor systems are manufactured by Pace Systems of North Hollywood, California. The present invention is comprised of two assemblies which may be employed either separately or in combination as described throughout this application. The first assembly is the batch assembly portion of a conveyor system which permits the transportation of a single trolley or of a train of trolleys. In the batching portion, the trolleys may move as a train and are not necessarily individually propelled along the track by individual drive capturing dogs. The batching portion employs flexible exciter dogs coupled to the driving chain to move the trolleys along the track through the batching portion and dispersing assembly. The upper and lower tracks in the batching section are spaced apart at a greater than normal distance so as to permit the individual drive capturing dogs to pass above the top of the trolleys without capturing or propelling the trolleys. The dispersing assembly which permits trolleys to accumulate at designated locations, normally at the end of the batching portion, permits individual dispatching of the trolleys into the system for distribution or to negotiate inclines and declines.

Figure 1:
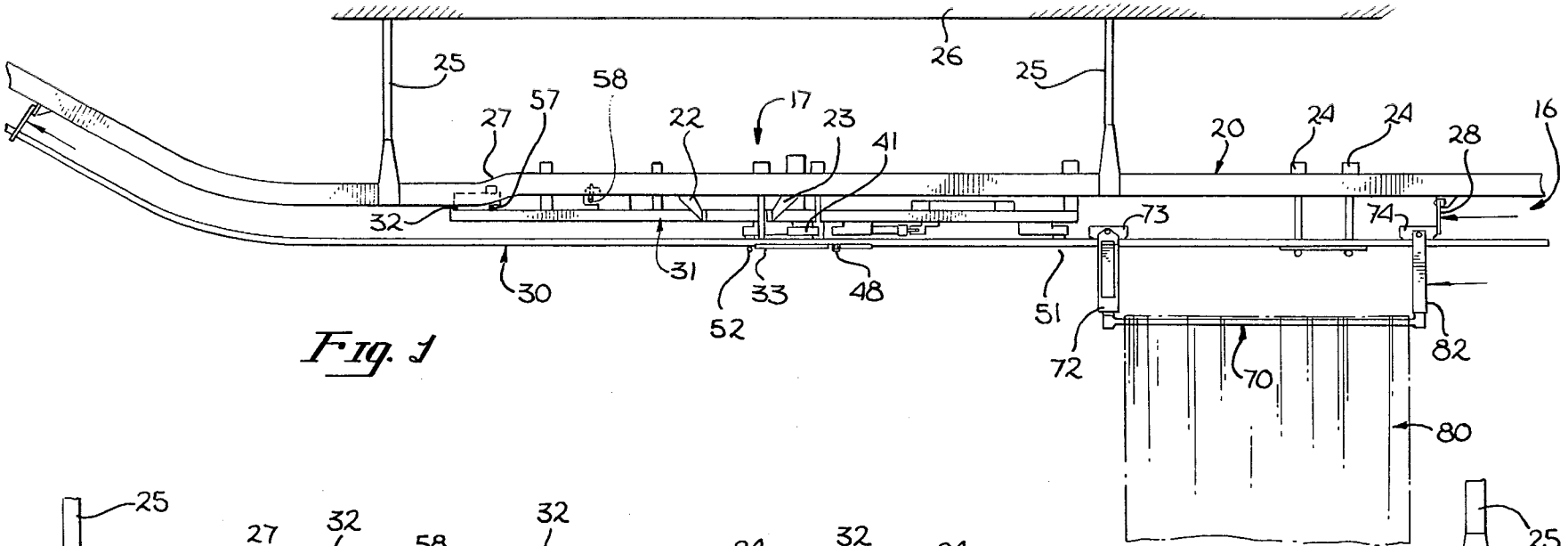
FIG. 1 is an elevation view of a portion of a conveyor system containing the batching portion and dispersing assembly of the present invention.
Figures 13, 14, 15:
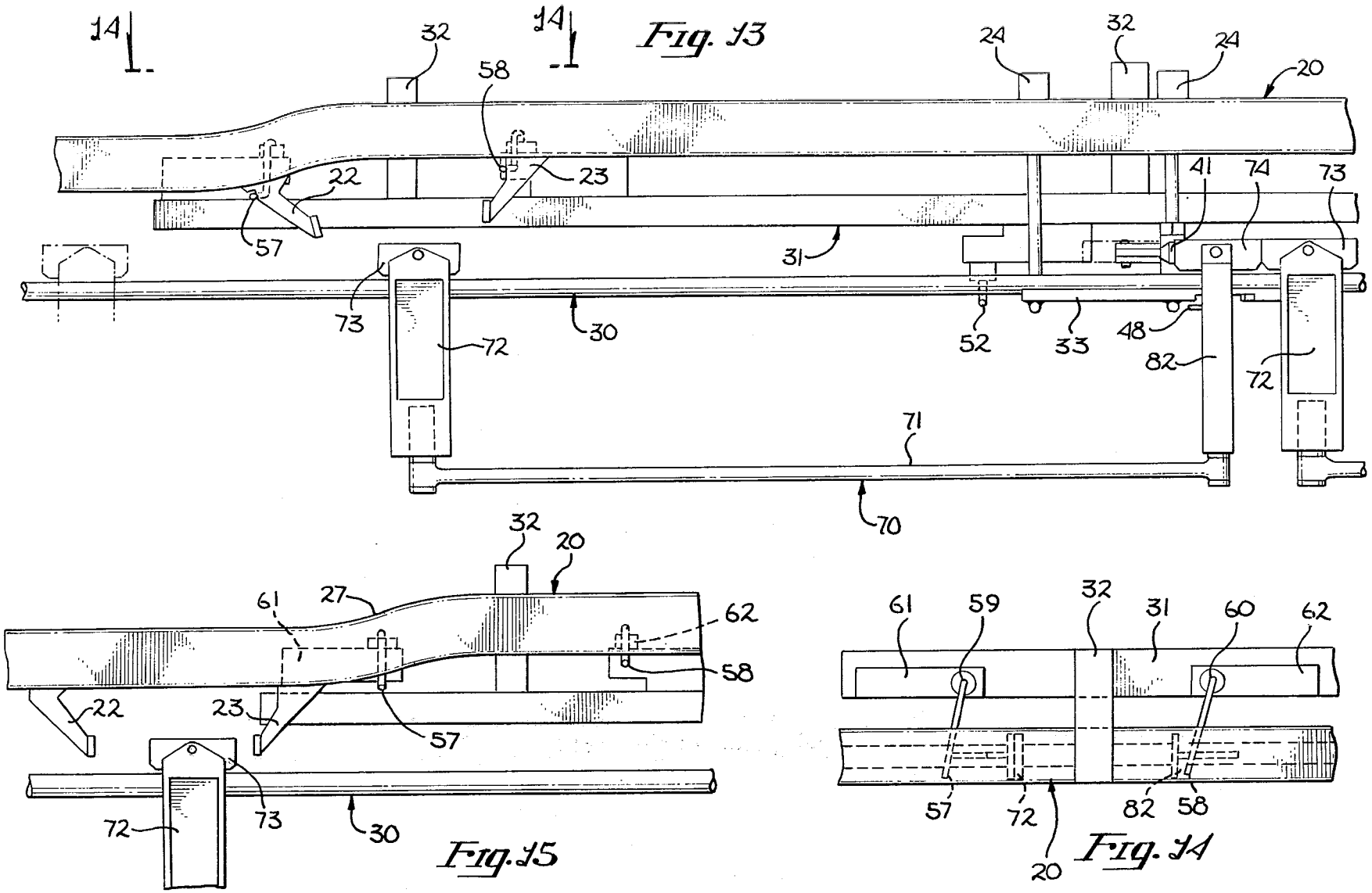
FIG. 13 is an elevation view of the dispersing assembly of FIG. 1 showing the drive capturing dogs contacting the upper activating switches releasing the leading trolley.
FIG. 14 is a cross-sectional view taken along line 14—14 of FIG. 13.
FIG. 15 is an elevation view of the drive capturing dogs of FIG. 13 capturing the trolley released from the dispersing assembly.

The batching portion 16, FIG. 1, of the present invention is formed by spaced apart upper and lower tracks 20 and 30 respectively of a conventional conveyor system. For example, the distance in a typical prior art conveyor system between the bottom of the upper track 20 and the top of the bottom track 30 is 2½ inches. A typical trolley employed with these conveyor systems has rolling heads, such as heads 73 and 74, FIG. 4, which ride along the top of the lower track such as lower track 30, extending upwards approximately 1½ inches therefrom. The drive capturing dogs, such as dogs 22 and 23 extend downward approximately 2 inches and are thus capable of capturing the rolling heads of the trolleys. The drive capturing dogs are coupled to a chain such as chain 21, FIG. 4, which is contained within the upper track and propels the drive capturing dogs throughout the system. Thus, in the prior art the drive capturing dogs captured the rolling head of a trolley and forced it to move along the system as is done in sections of the present invention as shown in FIG. 15.

The drive capturing dogs are formed from a rigid material to insure positive capturing and motivation of the rolling heads. Under normal operating conditions, each pair of drive dogs are spaced apart approximately 10 feet to permit proper functioning of the system. This use of known conveyor systems is very inefficient both as to space usage and the amount of necessary manual operation. Excessive manual labor time is required since each of the trolleys must be individually placed into the system only at intervals when free drive capturing dogs are available.

The batching portion 16 of the present invention employs a track of a conventional type, however, portions of the upper track are spaced from the lower track by an additional increment of approximately one inch in the presently preferred form. The increased spacing of the tracks is accomplished by bending the the upper track as shown in FIG. 1, or alternatively by bending the lower track downward. This increased spacing permits the drive capturing dogs 22 and 23 to pass over the rolling heads 73 and 74, FIG. 4, of each trolley 70, and hence an entire train of trolleys can be placed on the batching portion of the track without the necessity of being spaced apart.

Figure 4:
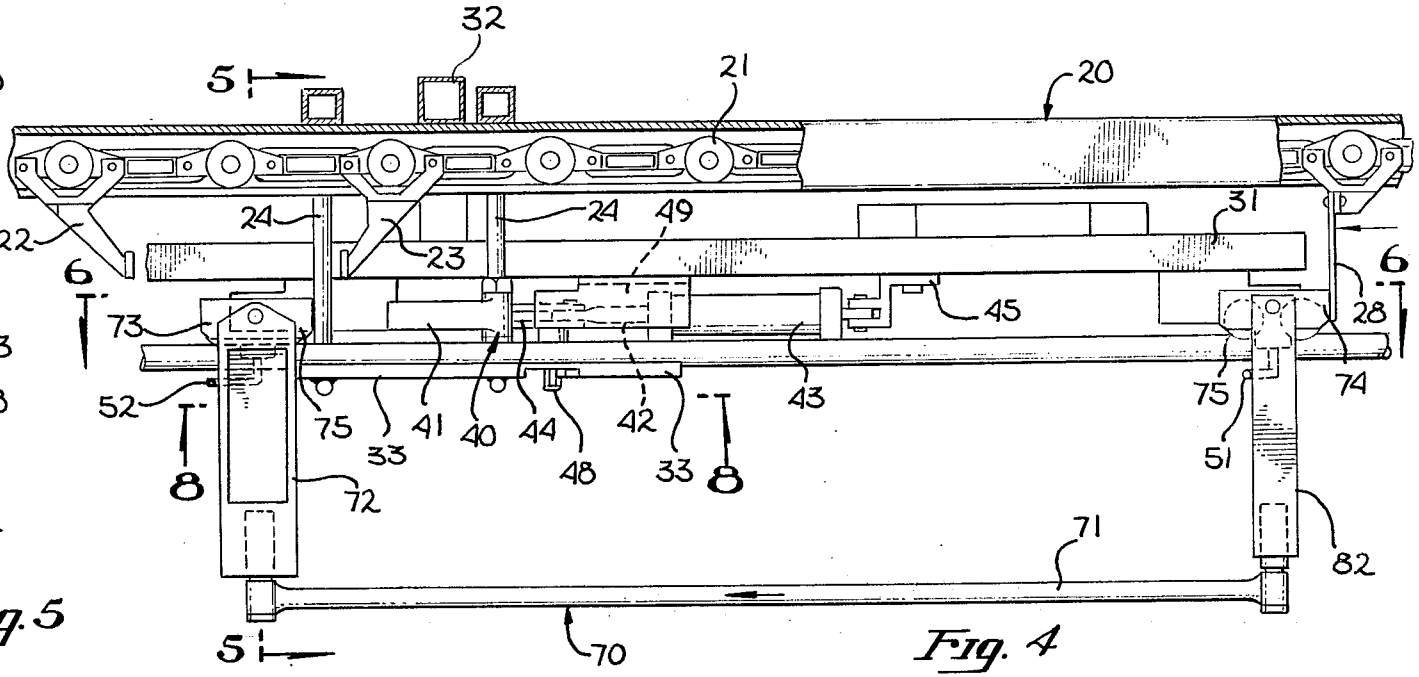
FIG. 4 is a partially cut away, expanded elevation view of a portion of the dispersing assembly of FIG. 1, with a trolley thereon.
Figure 5:
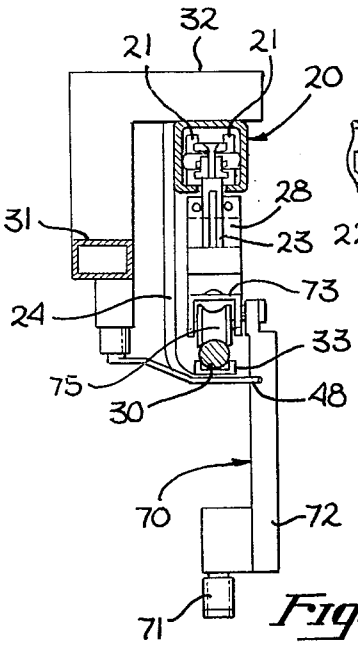
FIG. 5 is a cross-sectional view taken along line 5—5 of FIG. 4 illustrating the upper and lower tracks with a trolley on the lower track.

The upper and lower tracks 20 and 30 respectively are shown best in the cross sections of FIGS. 4 and 5. The upper track 20 is generally rectangular in cross section, having an open lower portion through which the drive capturing dogs 22 and 23 extend. A chain 21 is contained within the track and is used to drive the drive capturing dogs throughout the system. The lower track 30 is generally tubular in shape such that the wheels 75 of rolling head 73 of trolley 70 can engage the upper portion of the track 30 and easily roll thereon. The tracks are disposed in parallel disposition one above the other. The lower track 30 is secured to and supported from the upper track 20 by a plurality of fastening members 24 which are generally 'C' shaped. The upper track 20 is suspended from the ceiling 26 by a series of structural members 25 which are coupled to the upper track by welding or other known fastening means.

The intermediate support member 31 is disposed horizontally between the upper and lower tracks 20 and 30 respectively and is used to support switches 49, 61, 62, 55 and 56, the solenoid valves 90 and the mechanical stop assembly 40. The intermediate support member 31 is supported from the upper track 20 by a plurality of supporting members 32 as best illustrated in FIG. 2.

Figure 10:
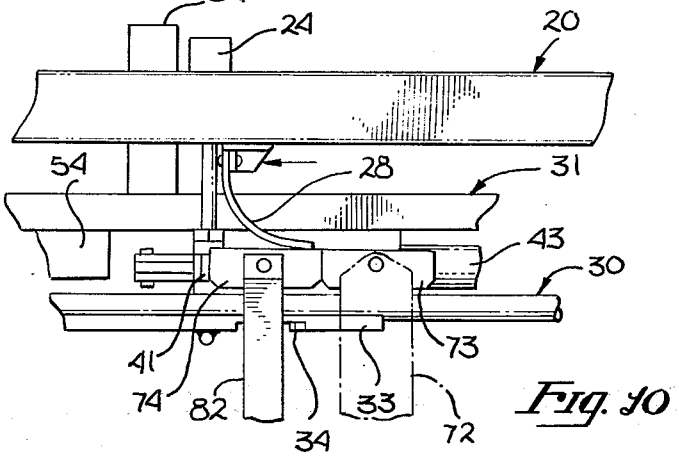
FIG. 10 is an expanded sectional view taken along line 10—10 of FIG. 9 illustrating a flexible exciter dog passing over the top of the trolley.
Figure 11:
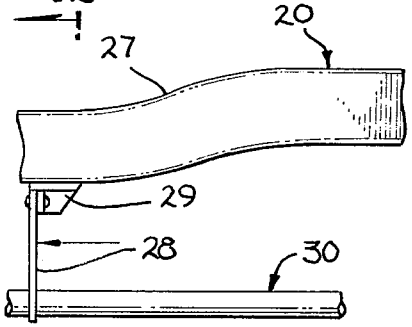
FIG. 11 is an expanded sectional view of the flexible exciter dog of FIG. 10 and upper and lower tracks.
Figure 12:
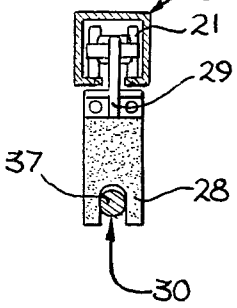
FIG. 12 is a cross-sectional view of the flexible exciter dog taken along the line 12—12 of FIG. 11.

The trolleys are moved along the batching portion 16 of the system by flexible exciter dogs 28 illustrated best in FIGS. 11 and 12. These exciter dogs 28 are formed from a flexible rubber belting which may be reenforced with nylon or other material and which, in the presently preferred form, is ¼ inch to 5/16 inches thick. The flexible dogs are coupled to the driving chain 21 in the upper track by a rigid metal coupling 29 and the flexible portion 28 is secured thereto by bolts or other known fastening means along the top edge thereof. The flexible dog 28 has an aperture 37 cut in the lower end which extends around a major portion of the lower track 30 as shown in FIG. 12. Aperture 37 permits the flexible exciter dog 28 to be aligned with lower track 30 so as to push the roller heads 73 and 74 of the trolleys without contacting the lower track 30. The flexible dogs 28 are spaced one from another a sufficient distance to permit driving a train of trolleys along the system. The spacing distance may vary since the weight and size of the trolleys may vary along with the average number of trolleys contained in a train. If the train becomes long and heavy, the flexible dog will ride over the rolling heads 73 and 74 of the trolleys and will not force them through the system. Thus, additional flexible exciter dogs 28 may be required to be added to the system to drive longer and heavier trains. The flexible dogs 28 provide sufficient force to drive the trolleys, yet when the trolleys reach an accumulation point, where they are forceably stopped, the flexible dogs will ride over the top of the rolling head of the trolley as best shown in FIG. 10.

If a train of trolleys is pushed along the tracks by the drive capturing dogs, a jam will occur at distribution points, accumulation points, or at inclines and declines. The same results will occur if the batching portion 16 of the present invention is attempted to be utilized without a dispersing assembly at either an accumulation point, distribution point or at an incline or decline. Thus, a dispersing assembly 17 which is capable of individually dispatching trolleys back into the conveyor system at these distribution points.

Figure 2:
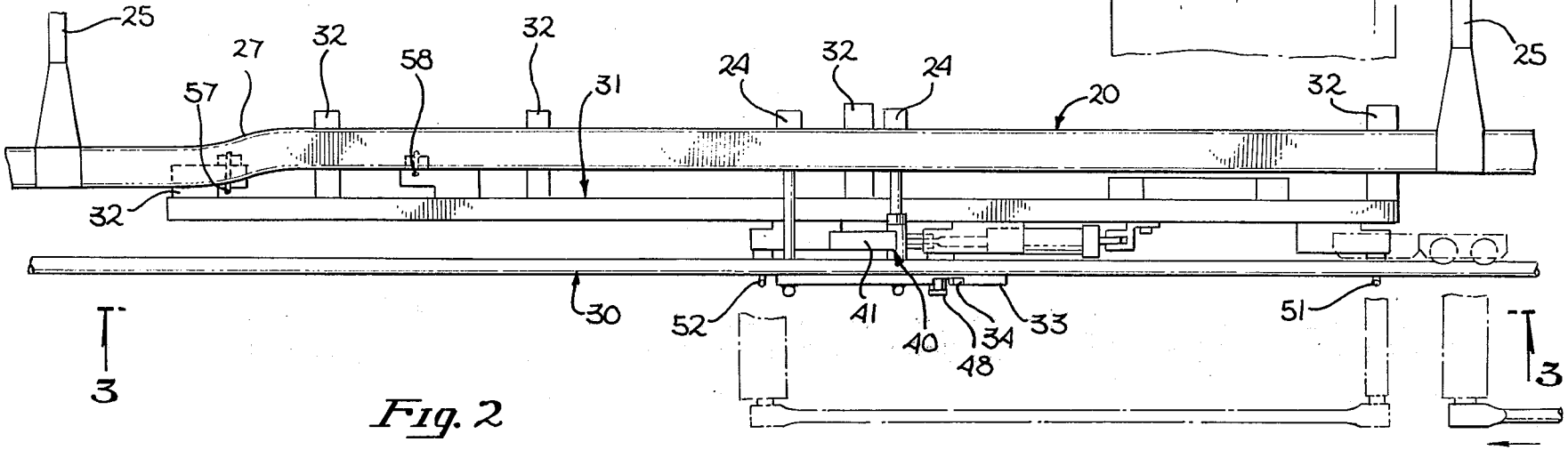
FIG. 2 is an expanded view of the dispersing assembly shown in FIG. 1.
Figure 3:
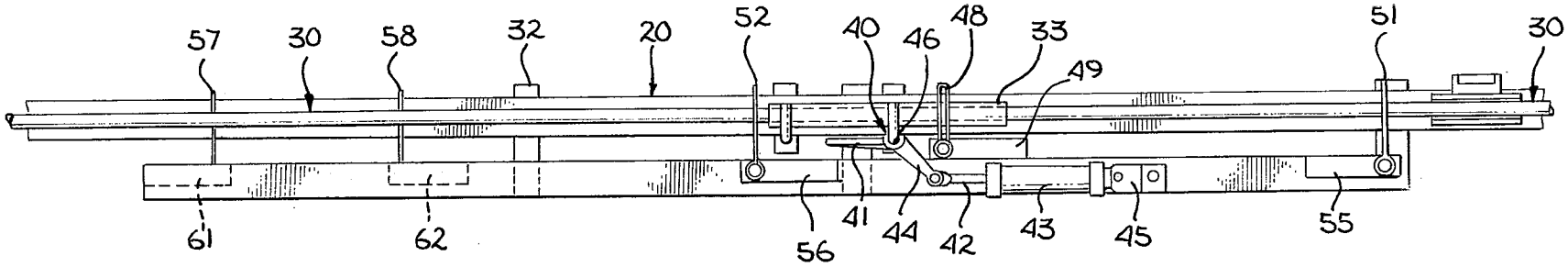
FIG. 3 is a bottom view of the dispersing assembly shown in FIG. 2 illustrating the mechanical stop in an open position.

Referring now to FIGS. 1 and 2, the dispersing assembly will be described. The dispersing section shown in FIG. 2 is capable of accumulating a train of trolleys within a batching portion of a conveyor system and thereafter individually dispatching the trolleys back into a conventional conveyor system having individual drive capturing dogs. The dispersing assembly is normally disposed immediately before an incline or distribution point but may be used at various other points within the system and is normally used to connect a batching portion to an existing conveyor system. Thus, the space between the upper and lower tracks must narrow at the exit of the dispersing assembly to match that of the conventional system.

The trolleys that are referred to in this disclosure are of the conventional type that are employed with the prior art conveyor systems. The dispersing assembly is described in reference to these trolleys, however, the dispersing system can be modified to operate with different trolleys. The trolleys referred to herein are disposed on the lower track such that the load carrying portion 71 is beneath the lower track 30 and parallel to both the upper and lower tracks. Vertical members 72 and 82 extend from the forward and rear roller heads 73 and 74 respectively to the end of the load carrying member 71 to the rolling heads. Vertical members 72 and 82 are coupled eccentrically from the rolling heads and load carrying members so as to pass freely along the system without contacting the lower track as best shown in FIG. 5.

The dispersing assembly 17 (FIG. 2) operates by projecting a mechanical stop 41 into the path of the rolling head 73 of a first trolley 70, which causes that trolley to stop and the following trolleys to accumulate therebehind forming a train. The assembly employs a system of switches to control a solenoid valve for actuation of a premature piston assembly to control the stop and release one trolley at a time into the system such that it is captured by a pair of drive capturing dogs. This system is described in detail below.

Figure 6:
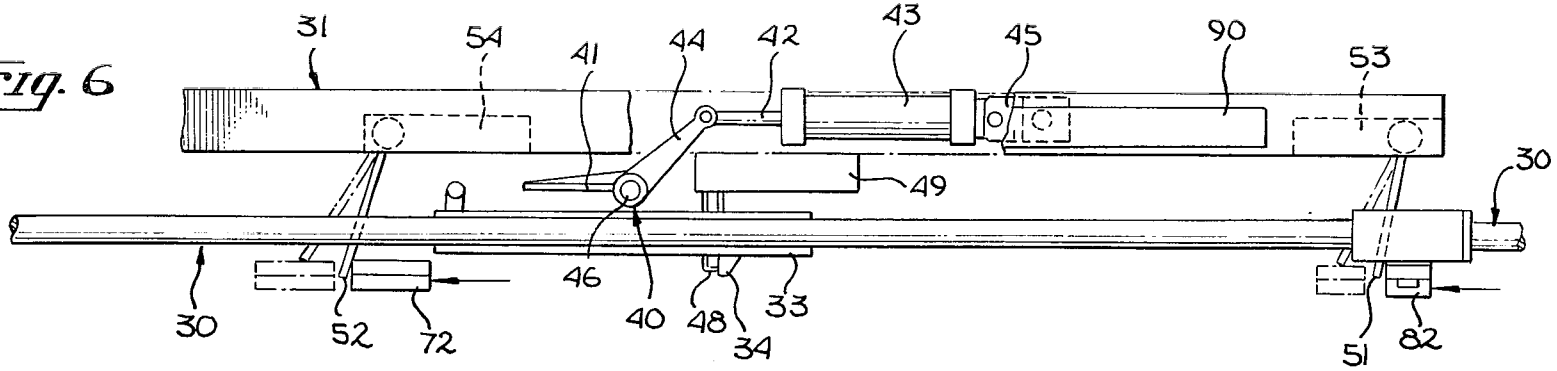
FIG. 6 is a bottom view taken along line 6—6 of FIG. 4 illustrating a trolley contacting the first set of activating switches.
Figure 7:
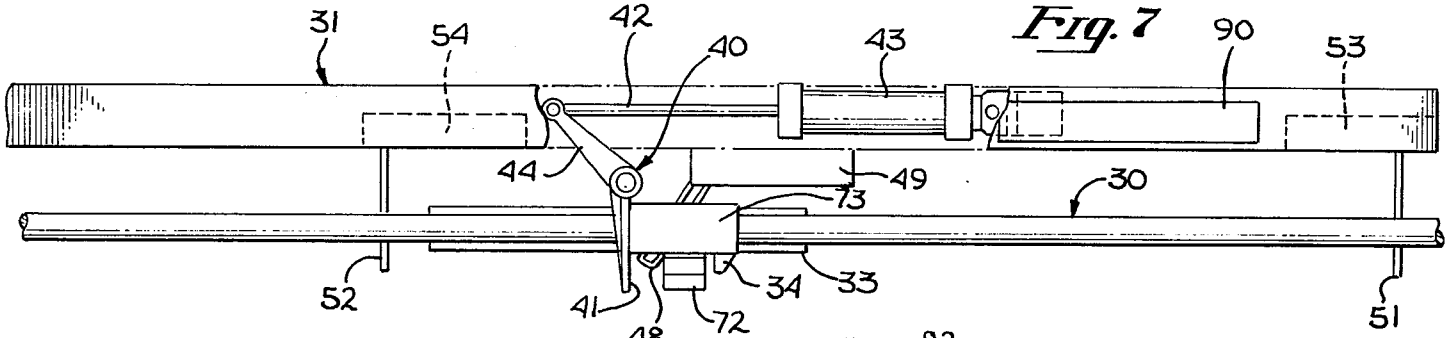
FIG. 7 is a bottom view taken along line 3—3 of FIG. 2 illustrating the stop in the closed position.
Figure 8:
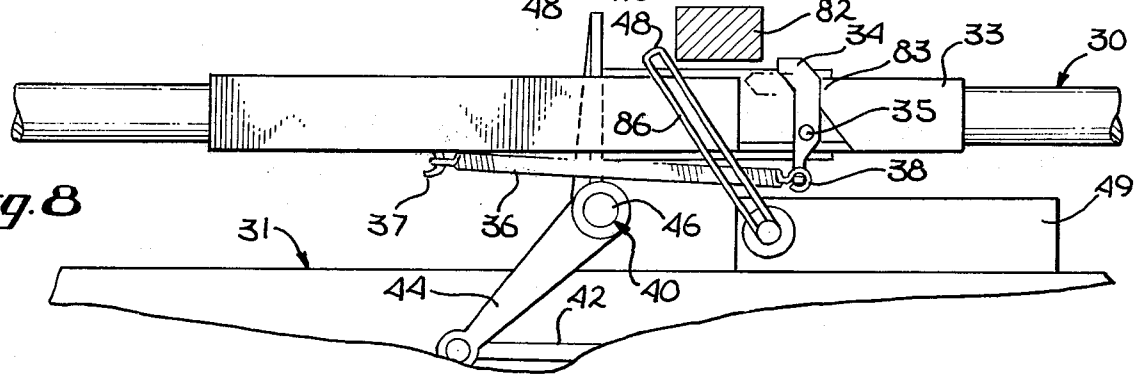
FIG. 8 is an expanded sectional view taken along line 8—8 of FIG. 4.

Referring first to FIGS. 6, 7 and 8 the mechanical stop assembly 40 which accumulates trolleys from the batching portion and releases them one at a time back into the conveyor system is shown. Referring specifically to FIG. 6, the mechanical stop assembly 40 is shown in its open position. In the open position, the trolleys are free to pass along the lower track without encountering the mechanical stop 41. The mechanical stop 41 is rotably mounted on shaft 46 and is integral with actuating arm 44. Arm 44 is coupled to piston rod 42 which is secured to a pneumatic piston 43 capable of being driven forward and backward by a double acting solenoid valve 90 such that rod 42 drives arm 44 which causes stop 41 to rotate from the open to closed position. Solenoid valve 90 is activated by a series of switches, the operation of which is disclosed hereinafter. The pneumatic piston and solenoid valve are cooperatively arranged in a conventional manner such that the piston, once driven to one position, will remain until driven to the opposite position.

An anti-reversing lever 34 is disposed beneath the lower track 30 in a groove in the bottom surface of member 33 which is secured to the bottom of track 30, as shown in FIG. 8. (A bottom view taken along line 8—8 of FIG. 4). The lever 34 engages the back edge of the vertical portion 82 of the trolley and thereby prevents it from reversing its path of travel. The anti-reversing lever 34 is formed so as to project from the side of the track toward the vertical member 82 of the trolleys, and is mounted rotably on pin 35. A spring 36 is disposed between end 38 of lever 34 and a hook 37 so as to cause the anti-reversing lever 34 to be urged such that it's tip projects outward toward the trolley. A stop 83, formed by the edge of the groove in member 33, limits rotation and allows the tip of the lever 34 to project so as to engage the trolleys. Lever 34 is generally curved on its rearward portion such that an approaching trolley may cause it to rotate about point 35 and permit the trolley to pass thereover in a forward direction. However, when the trolley passes the lever, the spring urges the lever to rotate back into its projecting position exposing a perpendicular surface which engages the backside of vertical member 82 of trolley 70. The trolley is thereby prohibited from rolling backwards, but is permitted to travel forward until engaging stop 41.

The dispersing assembly contains five interconnected solenoid switches which activate the solenoid valve and positions the mechanical stop assembly 40 causing one trolley at a time to be dispatched into the conveyor system and carried along by the individual drive capturing dogs 22 and 23. A pair of upper switches 61 and 62 have actuating members 57 and 58 respectively, disposed beneath the upper track as illustrated in FIGS. 13 and 14. The switch actuating members are spring loaded so as to be urged in position to engage the drive capturing dogs. Switch actuating members 57 and 58 are spaced apart a distance such that the forward part of forward dog 22 engages member 57 at the same time that the forward portion of the rear dog 23 engages member 58. A third switch 49 is provided having an actuating member 48 (FIG. 13) disposed so as to engage member 82 of a trolley to indicate the proper position of a trolley ready for release by the dispersing assembly. The solenoid switches 49, 61 and 62 are all electrically coupled in series to the solenoid valve 90 such that activation of one or two of the switches will not generate a signal to the solenoid valve, but simultaneous activation will activate the valve to drive the stop 41 to the open position shown in FIG. 6, and remain in that position until (double acting) solenoid valve 90 is activated to drive the pneumatic piston in the reverse direction.

A pair of switch actuating members 51 and 52 are disposed beneath the lower track 30 and project outward therefrom so as to be capable of engaging the vertical members 72 and 82 of the trolley 70 as best illustrated in FIGS. 2 and 6. The actuating members 51 and 52 are coupled to switches 53 and 54 respectively and are spaced apart such that the forward member 52 is capable of engaging the forward part of vertical member 72 at the same time that the member 51 engages the forward part of the rear vertical member 82. The switches are spring loaded so as to urge the actuating members into position to contact the vertical members of the trolley. The switches 53 and 54 are electrically coupled in series to the solenoid valve 90 to drive the pneumatic piston to the reverse position thus, activation of one of the switches at any time will not generate a signal to the system. However activation of both switches simultaneously will activate solenoid valve 90 to drive the stop 41 to the position shown in FIG. 7. As shown in FIG. 6, a trolley 70 is engaging both of the members 51 and 52 at the same time and thereby causing solenoid switches 53 and 54 to couple power to the solenoid valve.

Having now described the physical components of the dispersing assembly, the operation of those components will now be described in reference to their use. In the operating mode, the conveyor system is in continual movement. However trolleys are not always present in the batching portion and flexible exciter dogs 28 continually pass through the dispersing assembly without pushing trolleys. The mechanical stop 41 remains open during these periods since it is opened by the passage of a pair of dogs and is not closed until a trolley is in position. If the mechanical stop 41 is projected over the lower track 30, the flexible dogs 28 would ride over the mechanical stop 41 similar to the manner they ride over the trolley as shown in FIG. 10, which would cause the flexible dogs to wear unnecessarily. Thus, the system is designed as described to operate with stop 41 in the open position until a trolley is available for dispatching.

The procedure for opening and closing the mechanical stop and operating the dispersing assembly will now be described in detail. Referring to FIG. 1, a trolley 70 containing hanging merchandise 80 is shown approaching the dispersing assembly 17 through the batching portion 16. In the position shown, the vertical member 72 is approaching switch actuating member 51. However, since member 52 is not activated at precisely the same instant, the solenoid valve 90 will not be activated. As trolley 70 continues into the dispersing assembly, being pushed by flexible dog 28, the forward vertical member 72 of trolley 70 contacts the switch actuating member 52 while the rear vertical member 82 of trolley 70 contacts switch actuating member 51 as illustrated in FIG. 4. At this point, the forward rolling head 73 of trolley 70 has passed stop 41 and is continuing into the dispersing assembly. In FIG. 6, the trolley is shown contacting switch actuating members 51 and 52 and causing them to simultaneously activate their respective solenoid switches 53 and 54 so as to activate solenoid valve 90 thereby driving the pneumatic cylinder 43 to the extended position, causing stop 41 to rotate to block the path of oncoming trolley 70. As trolley 70 proceeds into the dispersing assembly, the rear rolling head 74 contacts stop 41 while the flexible exciter dog 28 bends and slips over the top of the rolling heads 72 and 74 as shown in FIG. 10. Prior to the rear rolling head contacting stop 41, the rear vertical member 82 of the trolley passes over antireversing lever 34 and contacts the switch actuating member 48. Anti-reversing lever 34 prevents the trolley from rolling backwards thereby trapping rolling head 74 between stop 41 and lever 34, causing switch 49 to remain in the closed position.

When solenoid switch 49 is activated, it enables the stop release electrical circuit and permits the paired solenoid switches 61 and 62 disposed beneath the upper track 20, shown in FIG. 13, to control. Thus, when the first driving dog 22 engages member 57 while dog 23 engages member 58 closing switches 61 and 62 respectively, and solenoid switch 49 is activated, power is coupled to solenoid valve 90 to cause the pneumatic cylinder 43 to be activated and rotate the mechanical stop 41 to the open position shown in FIG. 6, thereby permitting trolley 70 to be forced through the dispersing assembly by flexible dogs 28. As the trolley proceeds forward, the upper track slopes downward such that the upper rolling head 73 is capable of being captured between the drive capturing dogs 22 and 23 as shown in FIG. 15. The drive capturing dogs individually propel the trolley up or down the incline or through the distribution point. After the first trolley has left the dispersing assembly, the mechanical stop 41 remains in the open position until the next trolley 70 is driven forward and simultaneously actuates switches 53 and 54, thereby causing the mechanical stop 41 to rotate into the closed position, to confirm the respective trolley to a position in readiness for individual release.

Figure 9:
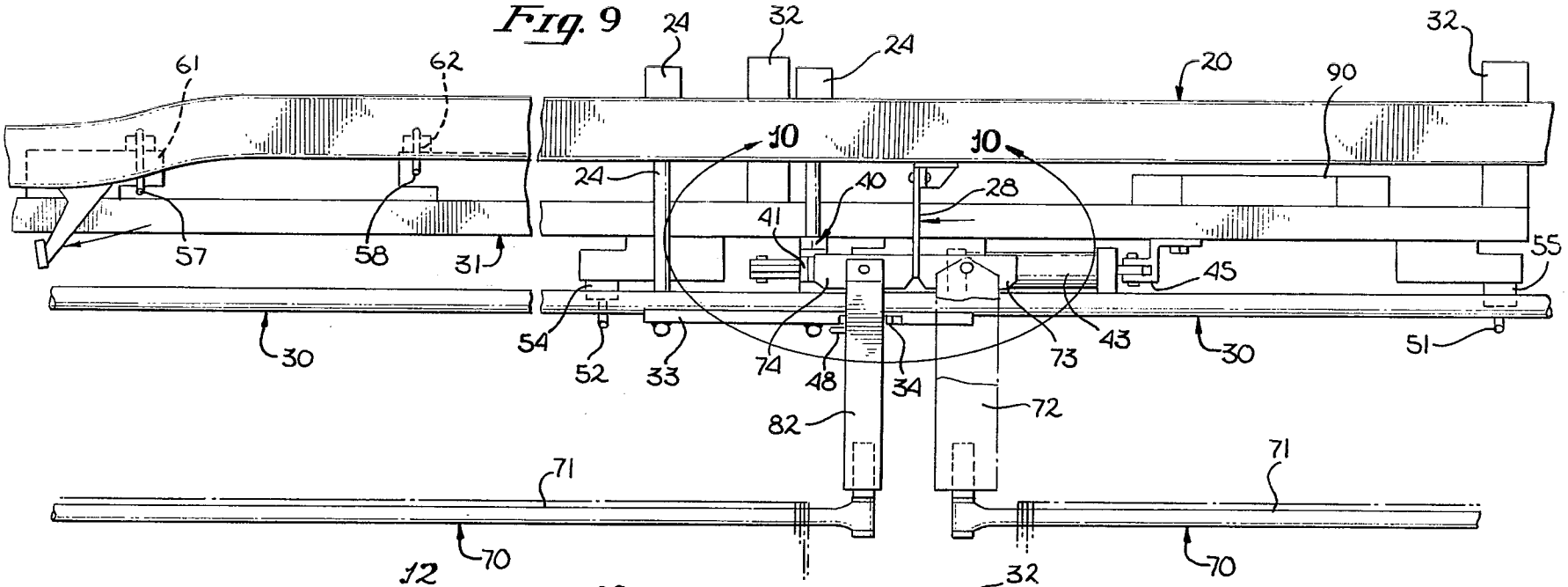
FIG. 9 is an elevation view of the dispersing assembly of FIG. 1 illustrating an accumulation of trolleys.

The dispersing assembly permits the accumulation of trolleys from the batching assembly as shown in FIGS. 9 and 13 and will individually permit the trolleys to be dispatched into the system. After the trolley has passed through the distribution point or up or down the incline, a separate batching portion can be employed by a simple diversion of the upper and lower tracks to accumulate and batch handle trolleys and thereby make a more efficient utilization of the space and conveyor system.

A safety feature of the present invention results from the fact that the mechanical stop 41 is driven into position by a pneumatic cylinder 43. The air pressure supplied by the pneumatic cylinder can be controlled such that when a certain pressure is exerted against a train of trolleys sufficient to cause jamming, the mechanical stop will open and permit a trolley to pass therethrough without causing a major jamming.

Thus, the present invention discloses a method for improving a conventional conveyor system such that batch processing may be employed to handle a train of trolleys while the dispersing assembly accumulates and individually dispatches them through distribution points, or up or down inclines. The invented structure minimizes the time an operator spends feeding the trolleys into the system, while providing efficient space usage of the conveyor system. The flexible dogs which propel the trolleys are capable of bending and passing over trolleys as they accumulate yet supply sufficient force to drive the trolleys. However, while the preferred embodiment of the present invention has been described in detail herein, it will be understood by those skilled in the art that various changes in form and detail may be made therein without departing from the spirit and scope of the invention.

I claim:

1. A system for batching and dispersing trolleys in a conveyor system having an upper track containing a driving chain coupled to at least one trolley drive capturing driving means, and a lower track spaced a first distance from said upper track for supporting trolleys, said system for batchings and dispersing comprising:

a. a batching portion wherein a plurality of trolleys may be transported in a group, said batching portion being formed by spacing said lower track from said upper track a second distance, said second distance being greater than said first distance;

b. a dispersing assembly for accumulating said trolleys and for individually dispatching said trolleys into said conveyor system, said dispersing section comprising a stop means for blocking the path of said trolleys;

c. a sensing means for activating said stop means;

d. a driving means for forcing batched trolleys through said batching portion and dispersing assembly.

2. The system of claim 1, wherein said driving means comprise flexible dogs coupled to said driving chain, said flexible dogs being a means for yieldably encouraging said trolleys along said lower track.

3. The system of claim 2, wherein said flexible dogs are fabricated from nylon reinforced rubber belting having a thickness of ¼ to 5/6 inches.

4. The system of claim 1, wherein said second distance between said upper and lower tracks is formed so that said trolley drive capturing means pass over said trolleys.

5. The system of claim 1, wherein said stop means is activated between first and second positions by a pneumatic cylinder and is capable of being disposed into the path of a trolley when in said first position to stop the progress of said trolley through said dispersing assembly.

6. The system of claim 1, wherein said sensing means is comprised of:

a. a first sensing means for sensing a trolley entering said dispersing assembly and for activating said stop means into said first position blocking the path of said trolley;

b. a second sensing means for sensing said drive capturing means as it leaves said dispersing assembly and for activating said stop means into said second position such that the stopped trolley is individually released and driven forward by said driving means and captured by said drive capturing means.

7. A system for batching and dispersing trolleys, in a conveyor system having an upper track containing a driving chain coupled to a trolley drive capturing means, and a lower track spaced a first distance from said upper track for supporting said trolleys, said trolleys having a first and second end, said system for batching and dispersing comprising;

a. a batching portion wherein a plurality of trolleys may be transported in a group, said batching portion being formed by spacing said lower track from said upper track a second distance, said second distance being greater than said first distance and sufficient to permit said drive capturing means to pass over said trolleys;

b. a dispersing assembly for accumulating said trolleys from said batching portion and for individually dispatching said trolleys into said conveyor system, said dispersing section comprising a stop means for blocking the path of said trolleys;

c. a plurality sensing means for activating said stop means;

d. a driving means for forcing batched trolleys through said batching portion and disbursing assembly, said driving means being flexible and coupled to said driving chain and capable of bending and sliding over said trolleys as said trolleys accumulate;

e. an anti-reversing means for preventing a stopped trolley from disengaging said stop means.

8. The system of claim 7, wherein said plurality of sensing means comprises:

a. a first sensing means comprising a spaced pair of first elongated members coupled to at least a first solenoid switch, said at least a first solenoid switch being activated only when both of said first elongated members are simultaneously displaced by said first and second end of said trolley, said activated first solenoid switch causes said stop means to be activated, said stop means thereby blocking the path of an oncoming trolley;

b. a second sensing means comprising of a spaced pair of second elongated members coupled to at least a second solenoid switch, said at least second solenoid switch being activated only when both of said elongated members are simultaneously contacted by said drive capturing means, said activated second solenoid switch causing said stop means to be activated thereby causing said stop means to unblock the path of said trolley.

c. a third sensing means coupled to said second sensing means comprised of a third elongated member coupled to at least a third solenoid switch, said third sensing means for closing a switch thereby completing a circuit and permitting said second sensing means to activate said stop means, said third sensing means activated when said trolley is positioned between said stop means and said anti-reversing means, said third sensing means activated by said third elongated member contacting said trolley.

9. In a conveyor system which includes an upper track containing a driving chain coupled to at least one drive capturing means, and a lower track spaced a first distance from said upper track for supporting trolleys, the improvement wherein a batching portion is formed by spacing said lower track from said upper track a second distance, said second distance being greater than said first distance and sufficient to permit said drive capturing means to pass over said trolleys, said trolleys in said batching portion propelled along by flexible driving means coupled to said driving chain.

10. The system of claim 9 wherein said flexible driving means comprise flexible dogs coupled to said driving chain, said flexible driving means being a means for yieldably encouraging said trolleys along said lower track.

11. The system of claim 10 wherein said flexible dogs are fabricated from nylon reinforced rubber belting having a thickness of ¼ to 5/16 inches.

12. In a conveyor system which includes an upper track containing a driving chain coupled to at least one drive capturing means, and a lower track spaced a first distance from said upper track for supporting trolleys, the improvement comprising a dispersing assembly for accumulating said trolleys and for individually dispatching trolleys into said conveyor system, said dispersing assembly comprising at least one stop means activated by sensing means having a. a first sensing means for sensing a trolley entering said dispersing assembly and for activating said stop means into said first position blocking the path of said trolley;

b. a second sensing means for sensing said drive capturing means as it leaves said dispersing assembly and for activating said stop means into said second position such that the stopped trolley is individually released and driven forward by said driving means and captured by said drive capturing means.

13. The system of claim 12 wherein said stop means is activated between a first and second position by a pneumatic cylinder and is disposed into the path of a trolley when in said first position to stop the progress of said trolley through said dispersing assembly.

* * * * *